United States Patent [19]

Yoshimura et al.

[11] Patent Number: 4,707,569

[45] Date of Patent: Nov. 17, 1987

[54] MULTI-CONDUCTOR CABLE

[75] Inventors: Shohei Yoshimura, Tomioka; Shigeki Fujimura; Itaru Sakamoto, both of Tokyo, all of Japan

[73] Assignee: Japan Styrene Paper Corporation, Tokyo, Japan

[21] Appl. No.: 866,313

[22] Filed: May 23, 1986

[30] Foreign Application Priority Data

Jun. 3, 1985 [JP] Japan ..... 60-83549[U]
Sep. 10, 1985 [JP] Japan ..... 60-137604[U]

[51] Int. Cl.[4] ..... H01B 7/02

[52] U.S. Cl. ..... 174/116; 174/110 F; 174/113 R

[58] Field of Search ..... 174/116, 110 F, 113 R

[56] References Cited

U.S. PATENT DOCUMENTS

| | | | |
|---|---|---|---|
| 2,315,736 | 4/1943 | Rosch | 174/116 |
| 3,603,718 | 9/1971 | Gedenk | 174/116 X |
| 3,644,659 | 2/1972 | Campbell | 174/116 X |
| 3,681,515 | 8/1972 | Mildner | 174/116 X |
| 3,683,104 | 8/1972 | Woodland et al. | 174/116 |
| 3,766,307 | 10/1973 | Andrews, Jr. | 174/116 |
| 3,829,603 | 8/1974 | Hansen et al. | 174/116 X |
| 3,843,831 | 10/1974 | Hutchison et al. | 174/116 |
| 3,857,996 | 12/1974 | Hansen et al. | 174/113 |
| 4,151,366 | 4/1979 | Betts et al. | 174/116 |

*Primary Examiner*—Morris H. Nimmo
*Attorney, Agent, or Firm*—Stephen F. K. Yee

[57] ABSTRACT

A multi-conductor cable such as an electrical power cable, a signal-transmission cable or optical fiber cable, including a core made of a plurality of insulated conductors, a sheath surrounding the core, and a plurality of foamed plastic string fillers which fill the void space between the core and the sheath and between the insulated conductors.

4 Claims, 7 Drawing Figures

MULTI-CONDUCTOR CABLE

This invention relates generally to cables and, more specifically, to multi-conductor cables such as electric power cables, signal-transmission cables and optical fiber cables.

A multi-conductor cable is generally composed of a core of a plurality of insulated conductors, a sheath surrounding the core, and a filler occupying the interstices within the core and between the sheath and the core. The filler serves to provide circular cross section of the cable, to prevent the deformation of the cable and to improve the tensile strength of the cable. Paper tapes, jute and split yarns of plastic films have been hitherto used as the filler. Since the filler is employed in relatively a large amount, it is desired to provide a filler which is unexpensive, light in weight and high in tensile strength.

There is provided in accordance with the present invention a cable comprising:

a core made of a plurality of insulated conductors, and a sheath surrounding the core, the void space between the core and the sheath and between the insulated conductors being filled with space fillers which include a plurality of strings formed of a foamed plastic material.

The present invention will now be described in detail below with reference, to the accompanying drawings, in which.

Figure 1:
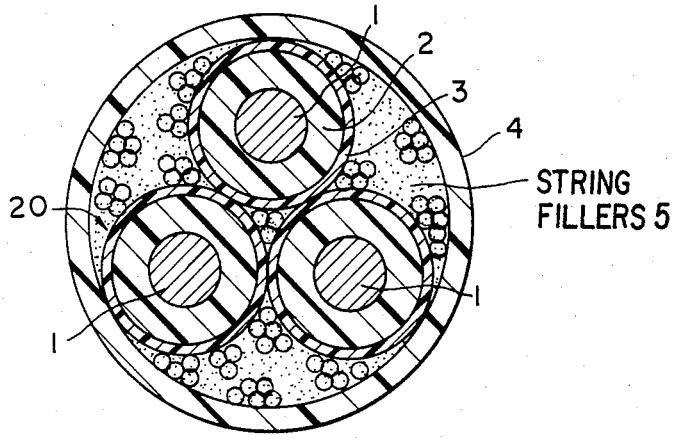
FIG. 1 is a cross-sectional view of a cable according to the present invention.

Referring first to FIG. 1, the cable according to the present invention includes a core made of a plurality (three in the particular illustrated case) of insulated conductors 20 each made of an electric wire 1, an insulator 2 such as of a plastic material and a covering 3. The core is surrounded by a sheath 4 formed, for example, of a plastic material such as polyethylene. The plastic sheath 4 may be extruded over the core and, if desired, bonded to the core. If necessary, a shielding tape (not shown) may be provided between the core and the sheath 4 for enclosing the bundled conductor assembly. The void space or interstices between the insulator conductors 20 and between the sheath 4 and the conductors 20 are filled with fillers including a plurality of strings 5 formed of a foamed plastic material.

Illustrative of suitable foamed plastic materials are foamed polyolefins such as polypropylenes, polyethylenes and polybutenes, polystyrenes and polyurethanes having an expansion ratio of about 3–100, preferably about 5–80. Above all, the use of a foamed polypropylene is particularly preferable for reasons of its excellent electrical and mechanical properties, high resistance to heat and inexpensiveness. Each string 5 may be longitudinally stretched to improve its strength, if desired.

Figure 2:
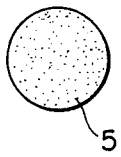
FIGS. 2 through 5 are enlarged, cross-sectional views diagrammatically showing filler strings according to the present invention.
Figure 3:
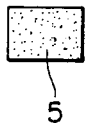

Examples of suitable strings 5 before being filled in the void space of the cable are schematically shown in FIGS. 2 through 5 by way of a cross section on a line perpendicular to the longitudinal axis of each string 5. The string 5 shown in FIG. 2 is a rope formed of a foamed plastic material and having a circular cross section, preferably with a diameter of about 0.5–10 mm. The string 5 shown in FIG. 3 has a rectangular cross section. The cross section of the string 5 may be any other shape such as ellipse, polygonal or the like.

It is preferred that the string 5 be in the form of a tape. The tape preferably has a thickness and a width such as to provide a diameter of about 3–10 mm when the tape is longitudinally folded or rolled to have a circular cross section. Preferably, the tape has a thickness of about 0.5–5 mm and a width of about 5–150 mm. The string 5 in the form of a tape can deform into any shape by application of mechanical stress. Thus, when the tapes are packed in the void space of the cable in a compressed state, the void space can be substantially entirely filled with the tapes without leaving any voids because of the elastic deformation of the tape fillers. Consequently, the resulting cable becomes uniform in size and in mechanical strength throughout its length.

Figure 4:
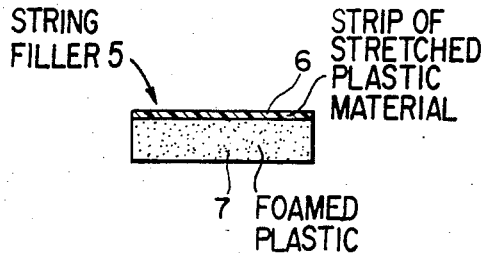

FIG. 4 depicts a preferred example of the string 5. The string 5 is a composite string formed of a thin strip tape 6 and a foamed plastic layer 7 integrally provided over the surface of the tape 6. The tape 6 serves as a reinforcing member and is preferably formed of a paper, a non-woven fabric or a plastic film having a thickness of about 5–50 $\mu$m. A plastic tape which is uniaxially stretched in a direction parallel to the lengthwise direction is particularly preferable. Examples of suitable plastic films include polypropylene films, polyethylene films, polybutene films, polyester films and polyacetal films. The composite string 5 shown in FIG. 4 may be prepared, for example, by a method including the steps of providing a stretched plastic film, superimposing a foamed plastic resin layer on the film, using, if necessary, an adhesive, and severing the resulting laminate into strings in a direction parallel to the stretching direction of the film.

Figure 5:
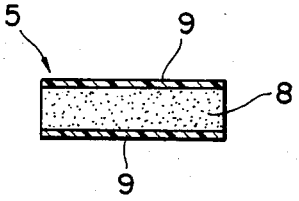

FIG. 5 depicts another example of the composite string according to the present invention. The composite string 5 is composed of a foamed plastic layer 8 with its both sides being bonded to two plastic tapes 9. With the composite strings of this embodiment, the production of a cable may be performed more easily since the strings have an improved slippage. That is, the friction between the strings, between the insulated conductors and the strings, between the guides and the strings and between the flared assembling tube and the strings which is caused during the assembling and bundling step may be reduced because each string has an outer surface covered with the plastic tapes 9.

Figure 6:
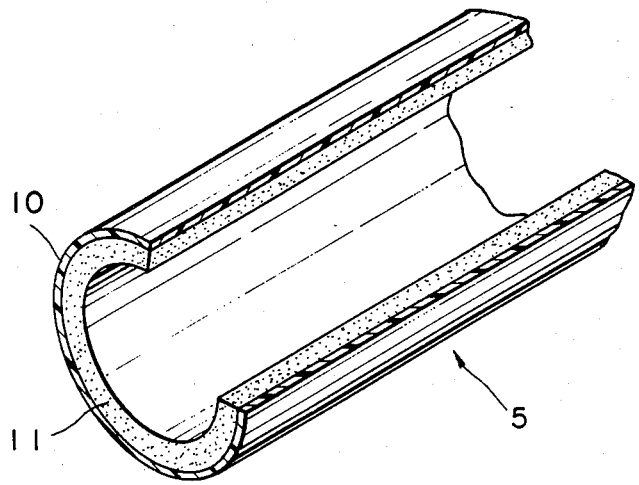
FIG. 6 is a a partial, enlarged perspective view diagrammatically showing a further embodiment of a filler string according to the present invention.

FIG. 6 illustrates a further embodiment, of the composite string 5. The string 5 is longitudinally folded to have a U-shaped or C-shaped cross section with its plastic tape 10 forming the outer surface of the string and with its foamed plastic layer 11 forming the inside surface. This structure can exhibit the same friction-reducing property as that of FIG. 5 but is more preferred because of the easiness to prepare, the effectiveness of the friction-reducing property and the lightness in weight. The curved string 5 may be prepared by a method similar to that for the string of FIG. 2. By using a combination of the plastic tape 10 and the foamed plastic layer 11 which has a more tendency to shrink than the tape 10, the composite string can be spontaneously curved. Alternatively, the desired curved structure may be obtained by compositing the plastic tape 10 with the foamed plastic layer 11 at such a temperature as to cause the shrinkage of the foamed plastic layer 11.

Figure 7:
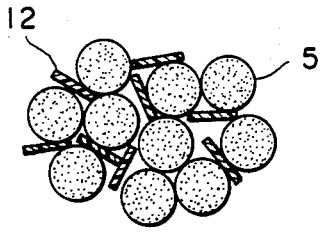
FIG. 7 is an enlarged, cross-sectional view diagrammatically showing an embodiment of space fillers according to the present invention.

The filler strings 5 according to the present invention may be used in conjunction with the conventional fillers such as slit yarns, paper tapes and the like. FIG. 7 illustrates such an embodiment. The fillers include foamed plastic strings 5 such as shown in FIG. 2 and slit yarns 12. It is preferred that at least 50 vol % of the space fillers filled in the cable be occupied by the foamed plastic strings 5 to satisfactorily accomplish the objects of the present invention.

The cable according to the present invention may be prepared in any known manner. For example, a desired number of insulated conductors and a suitable number of the strings are assembled by a flared forming tube to form a core continuously travelling in the lengthwise direction, with its upstream portion being covered with a plastic sheath by extrusion and cooled, thereby to continuously produce a cable. The cable thus obtained is light in weight because of the space fillers formed of a foamed plastic. Further, since the strings are elastically deformable, they can be easily assembled together with the insulated conductors to form a core and they can completely and evenly fill the void space within the cable sheath, so that the cable not only shows an improved elasticity but also has a substantially uniform cross section and uniform physical properties throughout the length.

The cable according to the present invention is not limited to an electric power cable and a signal-transmission cable. An optical fiber cable containing the above-described strings as space fillers is intended to be embraced within the scope of the present invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

We claim:

1. A cable comprising:

a core made of a plurality of insulated conductors, and a sheath surrounding the core, the void space between the core and the sheath and between the insulated conductors being filled with space fillers which include a plurality of strings, each of said strings being a composite formed of a reinforcing strip and a foamed plastic layer integrally bonded to said strip, said strip being formed of a plastic material stretched in the lengthwise direction.

2. A cable as claimed in claim 1, wherein each of said strings is in the form of a tape having a thickness of about 0.5–5 mm and a width of about 5–150 mm.

3. A cable as claimed in claim 1, wherein each of said strings is longitudinally folded or curved to have a U-shaped or C-shaped latitudinal cross section with said strip forming the external surface of the string.

4. A cable as claimed in claim 1, wherein each of said strings comprises said foamed plastic layer sandwiched between two said strips.

* * * * *